US007080994B1

(12) United States Patent
Lewis

(10) Patent No.: US 7,080,994 B1
(45) Date of Patent: Jul. 25, 2006

(54) ADJUSTABLE POWER OUTLET

(76) Inventor: Jeremy L. Lewis, 5401 Cinderella Rd., Charlotte, NC (US) 28213

( * ) Notice: Subject to any disclaimer, the term of this patent is extended or adjusted under 35 U.S.C. 154(b) by 0 days.

(21) Appl. No.: 11/148,024

(22) Filed: Jun. 9, 2005

(51) Int. Cl.
*H01R 25/00* (2006.01)

(52) U.S. Cl. ..... 439/120; 439/110

(58) Field of Classification Search ..... 439/110–116, 439/119–122, 214–216
See application file for complete search history.

(56) References Cited

U.S. PATENT DOCUMENTS 4,148,544 A 4/1979 Markowitz
4,489,995 A 12/1984 Barr
4,690,474 A * 9/1987 Smart et al. ..... 439/120
5,052,937 A 10/1991 Glen
5,183,406 A * 2/1993 Glen ..... 439/120
5,418,328 A * 5/1995 Nadeau ..... 174/48
5,582,520 A * 12/1996 Doudon ..... 439/106
5,915,984 A 6/1999 Rupert et al.
5,957,701 A 9/1999 McMillin
6,791,788 B1 * 9/2004 Gustafson et al. ..... 360/92
2003/0148644 A1 8/2003 Milan

* cited by examiner

*Primary Examiner*—Gary F. Paumen

(57) ABSTRACT

A power outlet includes a housing that has walls sized and shaped for defining a rectilinear and longitudinal length. A front wall is provided with equidistantly spaced and coextensive tracks extending parallel to each other and traveling along a major portion of the front wall. Coextensive electrical sockets are partially positioned within the housing and include front faces exposed from the front wall for receiving power cords from the auxiliary loads respectively. A mechanism is included for independently positioning the electrical sockets along the tracks respectively such that the electrical sockets can be slidably guided between opposite ends of the housing. An external power cord is directly mated to the electrical sockets for supplying power thereto.

15 Claims, 3 Drawing Sheets

ADJUSTABLE POWER OUTLET

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to power outlets and, more particularly, to an adjustable power outlet for distributing electricity to auxiliary loads.

2. Prior Art

In conventional residential and commercial construction, outlets for electricity and telephone lines are installed in the walls of a room at fixed, spaced locations around the room. When changes are made in the location of the devices using these outlets, it is often necessary to change the location of the outlet, which involves installing a new outlet in the wall, repairing the drywall, and repainting at the previous location. This is particularly time-consuming and expensive in the commercial office situation where such moves are relatively frequent.

Various systems have been designed to provide a conductive track along which a receptacle may be moved. One of the primary considerations in such a design is that the conductive elements must be guarded against accidental contact by a child or user. One example discloses an electrical outlet comprising an elongated housing having a lengthwise slot and a conductor extending along the length of the housing. An electrical receptacle rides along the slot by means of rollers which contact the conductor. The receptacle is not provided with a ground connection as is required in modern electrical systems, and in order to change the position of the receptacle, it is necessary to roll it completely around the track from one location to the other. This may cause unnecessary complications where there are a number of receptacles along a track and only one needs to be moved to another location. Further, apparently the receptacle cannot be rigidly secured at the selected location.

Another movable electrical receptacle uses various means to guard the conductors, including a zipper arrangement, a pair of overlapping ribbons, and a recessed rib. The same disadvantages noted for the previous example also apply to this design. Yet another example discloses an electrical distribution system in which a specially designed plug may be inserted in any one of a number of apertures along a continuous conductor. However, it does not allow for the use of conventional plugs. Also disclosed in the prior art is a safety wall plug in which the plug is slid from the peripheral edge of the wall outlet to the inner edge of a passage in the wall outlet. It, however, does not permit the movement of the electrical outlet's position.

Accordingly, a need remains for an adjustable power outlet in order to overcome the above-noted shortcomings. The present invention satisfies such a need by providing a power outlet that is easy and convenient to use, easy to install, compact in design, provides considerable time savings, and is reasonably priced. Homeowners find such an adjustable power outlet design quite helpful, since they no longer have to move heavy furniture in order to reach the outlet. Commercial establishments also appreciate the adjustable outlet, since it eliminates the need to relocate an electrical outlet when the office is rearranged.

BRIEF SUMMARY OF THE INVENTION

In view of the foregoing background, it is therefore an object of the present invention to provide an adjustable power outlet. These and other objects, features, and advantages of the invention are provided by an adjustable power outlet for distributing electricity to auxiliary loads.

The power outlet includes a housing that has a plurality of monolithically formed walls sized and shaped for defining a rectilinear and predetermined longitudinal length. A front one of the walls is provided with a plurality of equidistantly spaced and coextensive tracks extending parallel to each other. Such tracks travel along a major portion of the front wall.

A plurality of coextensive electrical sockets are partially positioned within the housing and include front faces exposed from the front wall for conveniently receiving a plurality of power cords from the auxiliary loads respectively. Such electrical sockets are preferably advantageously independently adaptable along the driven shafts. An external power cord is directly mated to the electrical sockets for effectively supplying power thereto.

A mechanism is included for independently positioning the electrical sockets along the tracks respectively such that the electrical sockets can advantageously be slidably guided between opposite ends of the housing as desired by a user. The independently positioning mechanism preferably includes a plurality of motors including a plurality of drive gears provided with a serrated outer surface. Such drive gears are directly connected to the motors and rotatably operable about a centrally registered fulcrum axis situated orthogonal to the longitudinal length of the housing. The motors and the drive gears are disposed within the housing.

A plurality of elongated and rectilinear driven shafts have opposed end portions directly conjoined to selected ones of the walls respectively. Each of the driven shafts has a threaded surface rotatable in clockwise and counter clockwise directions respectively. The electrical sockets are directly and operably conjoined to the driven shafts in such a manner that the electrical sockets effectively travel linearly along a longitudinal length of the tracks as the driven shafts are rotated in the clockwise and counter clockwise directions.

A plurality of ring gears are preferably operably and directly connected to the drive shafts respectively. Such ring gears are operably and directly positioned about the driven shafts in such a manner that the ring gears cause the driven shafts to rotate in a first direction when the drive shafts are rotated in a second direction. A plurality of controls are situated to an exterior of the housing and are operably coupled to the motors respectively.

The independent positioning mechanism may further include at least one optical sensor directly fastened to one of the end portions of the driven shaft and is nested within the housing. A transformer and a controller are electrically mated to the external power cord, wherein the optical sensor generates and transmits a control signal to the controller for effectively notifying the controller whether the electrical sockets have been displaced at a predetermined maximum distance along the driven shafts respectively. Such a controller generates and transmits a response signal to the motors for advantageously automatically restricting the linear movements of the electrical outlets.

The simultaneous positioning mechanism preferably further includes a plurality of bearings directly nested about the opposed end portions of the driven shafts for effectively promoting continuous and smooth rotation during operating conditions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
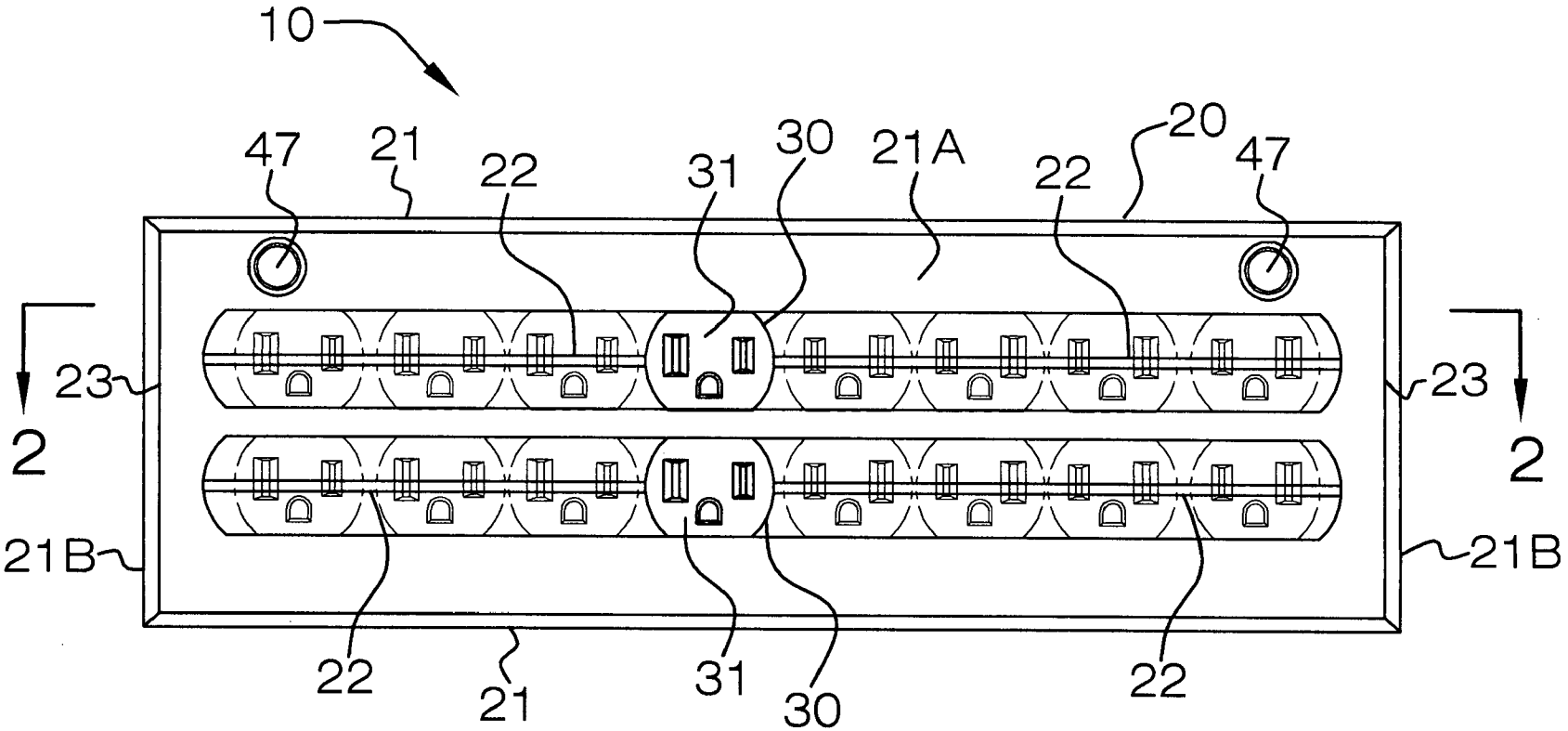
FIG. 1 is a front-elevational view showing an adjustable power outlet, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1–4 by the reference numeral 10 and is intended to provide an adjustable power outlet. It should be understood that the device 10 may be used to provide adjustable power outlets in many different types of settings and should not be limited in use to only residential buildings.

Referring initially to FIG. 1, the device 10 includes a housing 20 that has a plurality of monolithically formed walls 21 sized and shaped for defining a rectilinear and predetermined longitudinal length. Of course, such a housing 20 may be produced in a variety of different shapes, sizes and colors so as to accommodate any decorative scheme, as is obvious to a person of ordinary skill in the art. A front one 21A of the walls 21 is provided with a plurality of equidistantly spaced and coextensive tracks 22 extending parallel to each other. Such tracks 22 travel along a major portion of the front wall 21A.

Figure 2:
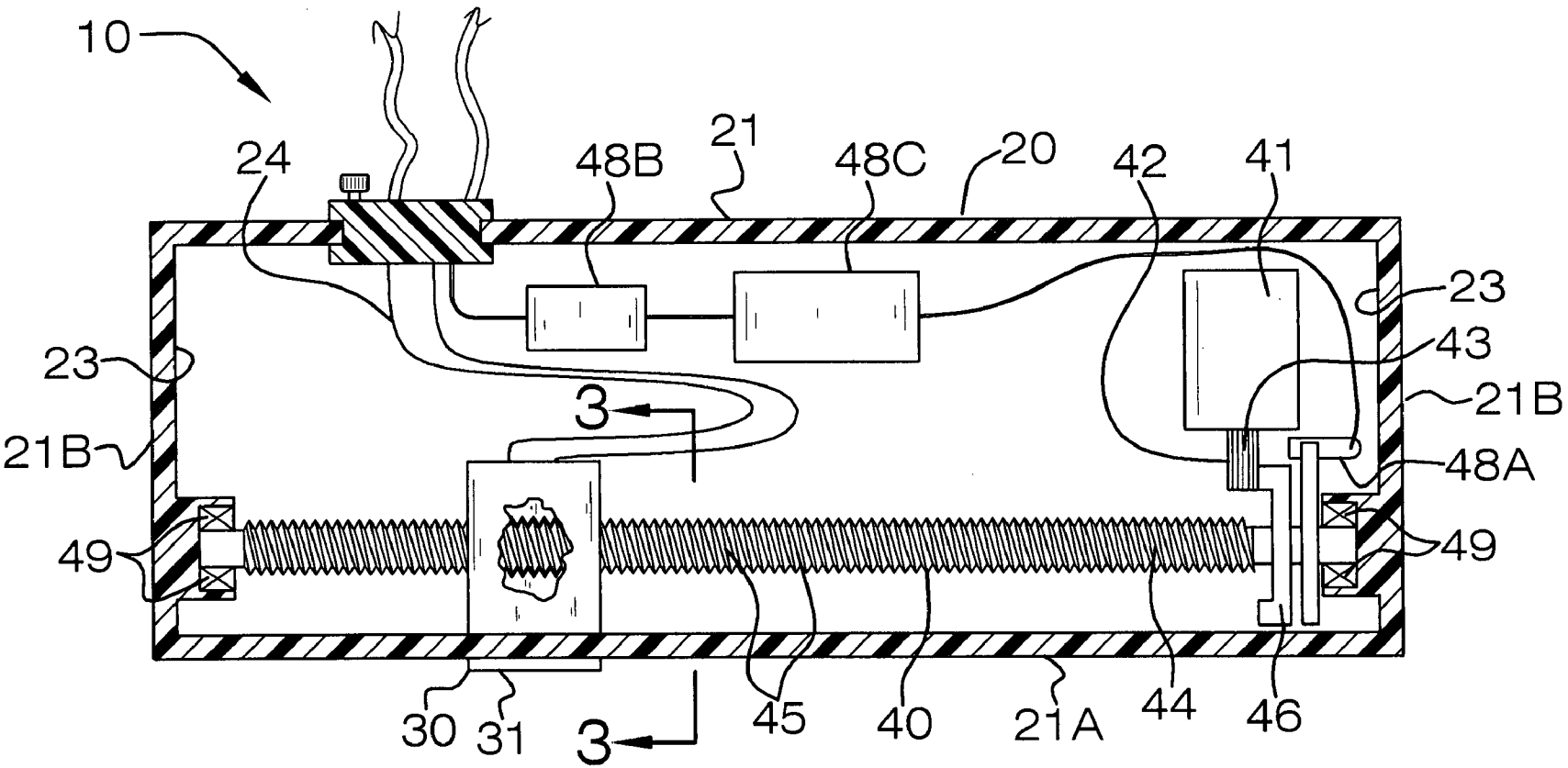
FIG. 2 is a cross-sectional view of the device shown in FIG. 1, taken along line 2—2.
Figure 3:
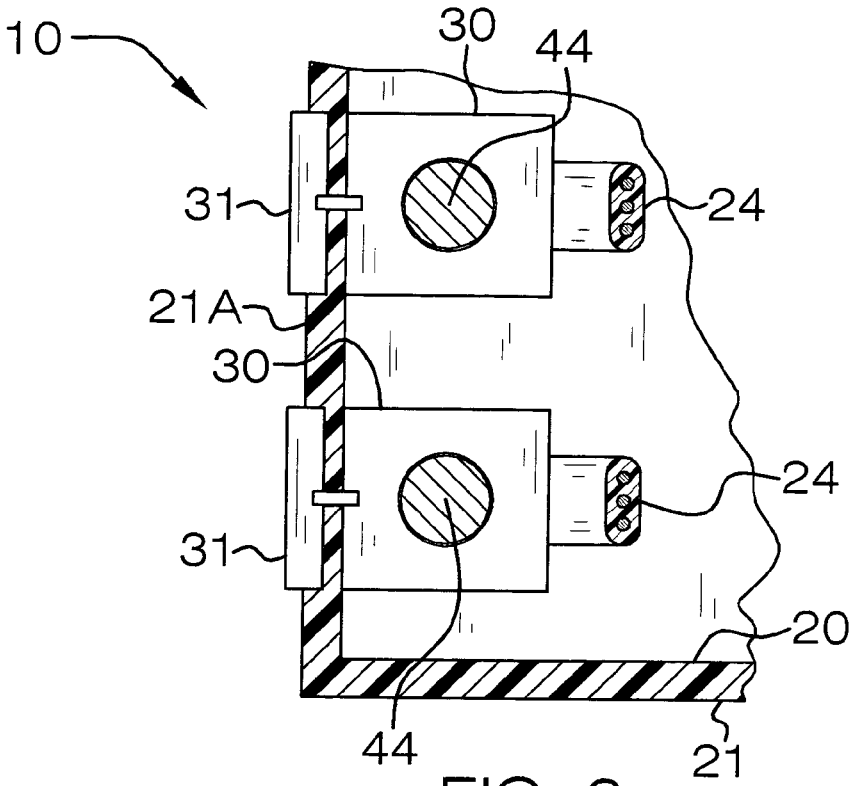
FIG. 3 is a cross-sectional view of the device shown in FIG. 2, taken along line 3—3.

Referring to FIGS. 1 through 3, a plurality of coextensive electrical sockets 30 are partially positioned within the housing 20 and include front faces 31 exposed from the front wall 21A for conveniently receiving a plurality of power cords (not shown) from the auxiliary loads respectively. Such electrical sockets 30 are advantageously independently adaptable along the driven shafts 44 (described herein below). It is anticipated by those skilled in the art that the device 10 may be produced to include any number of electrical sockets 30 and should thus not be limited to only two electrical sockets 30, as shown in the figures included herewith. An external power cord 24 is directly mated, with no intervening elements, to the electrical sockets 30 for effectively supplying power thereto.

Referring to FIGS. 2 and 3, a mechanism 40 is included that is essential for independently positioning the electrical sockets 30 along the tracks 22 respectively such that the electrical sockets 30 can advantageously be slidably guided between opposite ends 23 of the housing 20 as desired by a user, especially in situations where access to the sockets 30 is impeded by furniture or some other obstacle. The independently positioning mechanism 40 includes a plurality of motors 41 including a plurality of drive gears 42 provided with serrated outer surfaces 43. Such drive gears 42 are directly connected, with no intervening elements, to the motors 41 and rotatably operable about a centrally registered fulcrum axis situated orthogonal to the longitudinal length of the housing 20. The motors 41 and the drive gears 42 are disposed within the housing 20, thus advantageously maintaining the aesthetic appearance of the device 10.

Still referring to FIGS. 2 and 3, a plurality of elongated and rectilinear driven shafts 44 have opposed end portions directly conjoined, with no intervening elements, to selected ones 21B of the walls 21 respectively. Each of the driven shafts 44 has a threaded surface 45 rotatable in clockwise and counter clockwise directions respectively, which is essential for effectively allowing left and right movement of the sockets 30 therealong. The electrical sockets 30 are directly and operably conjoined, with no intervening elements, to the driven shafts 44 in such a manner that is crucial for allowing the electrical sockets 30 to effectively travel linearly along a longitudinal length of the tracks 22 as the driven shafts 44 are rotated in the clockwise and counter clockwise directions.

Figure 4:
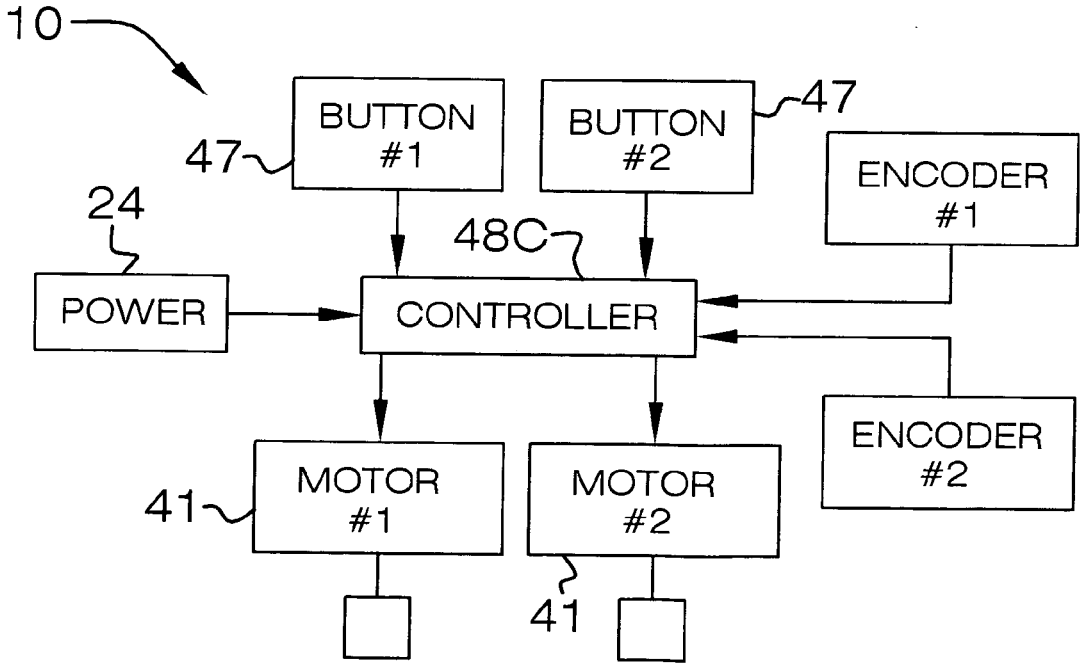
FIG. 4 is a schematic block diagram of the device shown in FIG. 1.

Referring to FIGS. 1, 2 and 4, a plurality of ring gears 46 are operably and directly connected, with no intervening elements, to the drive shafts 44 respectively. Such ring gears 46 are operably and directly positioned, with no intervening elements, about the driven shafts 44 in such a manner that is vital for allowing the ring gears 46 to cause the driven shafts 44 to rotate in a first direction when the drive shafts 42 are rotated in a second direction. A plurality of controls 47 are situated to an exterior of the housing 20 and are operably coupled to the motors 41 respectively. Such controls 47 are critical and advantageous for allowing a user to easily adjust a horizontal displacement of the sockets 30 along the front wall 21A of the housing 20 by simply depressing the controls 47. Of course, the device 10 may also be provided with a remote control device (not shown) allowing the user to conveniently adjust a location of the sockets 30 along the tracks 22 from a remote location, as is obvious to a person of ordinary skill in the art.

Referring to FIGS. 2 and 4, the independent positioning mechanism 40 further includes at least one optical sensor 48A directly fastened, with no intervening elements, to one of the end portions of the driven shaft 44 and nested within the housing 20. A transformer 48B and a controller 48C are electrically mated to the external power cord 24, wherein the optical sensor 48A is important for generating and transmitting a control signal to the controller 48C for effectively notifying the controller 48C whether the electrical sockets 30 have been displaced at a predetermined maximum distance along the driven shafts 44 respectively. Such a controller 48C generates and transmits a response signal to the motors 41, which is essential for advantageously automatically restricting the linear movements of the electrical outlets 30.

Referring to FIG. 2, the simultaneous positioning mechanism also further includes a plurality of bearings 49 directly nested, with no intervening elements, about the opposed end portions of the driven shafts 44 that are vital for effectively promoting continuous and smooth rotation during operating conditions. Such bearings 49 advantageously ensure the device 10 operates quietly and efficiently, thus increasing the appeal thereof to consumers.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and desired by Letters Patent of the United States is:

1. An adjustable power outlet for distributing electricity to auxiliary loads, said power outlet comprising:

a housing having a plurality of monolithically formed walls sized and shaped for defining a rectilinear and predetermined longitudinal length, a front one of said walls being provided with a plurality of equidistantly spaced tracks extending parallel to each other, said tracks traveling along a major portion of said front wall;

a plurality of electrical sockets partially positioned within said housing and including front faces exposed from said front wall for receiving a plurality of power cords from the auxiliary loads respectively;

means for independently positioning said electrical sockets along said tracks respectively such that said electrical sockets can be slidably guided between opposite ends of said housing as desired by a user; and an external power cord directly mated to said electrical sockets for supplying power thereto.

2. The power outlet of claim 1, wherein said independently positioning means comprises:

a plurality of motors including a plurality of drive gears provided with a serrated outer surface, said drive gears being directly connected to said motors and rotatably operable about a centrally registered fulcrum axis situated orthogonal to the longitudinal length of said housing, said motors and said drive gears being disposed within said housing;

a plurality of elongated and rectilinear driven shafts having opposed end portions directly conjoined to selected ones of said walls respectively, each said driven shafts having a threaded surface rotatable in clockwise and counter clockwise directions respectively;

a plurality of ring gears operably and directly connected to said drive shafts respectively, said ring gears being operably and directly positioned about said driven shafts in such a manner that said ring gears cause said driven shafts to rotate in a first direction when said drive shafts are rotated in a second direction; and a plurality of controls situated exterior of said housing and operably coupled to said motors respectively;

wherein said electrical sockets are directly and operably conjoined to said driven shafts in such a manner that said electrical sockets travel linearly along a longitudinal length of said tracks as said driven shafts are rotated in the clockwise and counter clockwise directions.

3. The power outlet of claim 2, wherein said independent positioning means further comprises:

at least one optical sensor directly fastened to one said end portions of said driven shaft and nested within said housing; and a transformer and a controller electrically mated to said external power cord;

wherein said optical sensor generates and transmits a control signal to said controller for notifying said controller whether said electrical sockets have been displaced a predetermined maximum distance along said driven shafts respectively, said controller generating and transmitting a response signal to said motors for automatically restricting the linear movements of said electrical outlets.

4. The power outlet of claim 2, wherein said electrical sockets are independently adaptable along said driven shafts.

5. The power outlet of claim 2, wherein said simultaneous positioning means further comprises:

a plurality of bearings directly nested about said opposed end portions of said driven shafts for promoting continuous and smooth rotation during operating conditions.

6. An adjustable power outlet for distributing electricity to auxiliary loads, said power outlet comprising:

a housing having a plurality of monolithically formed walls sized and shaped for defining a rectilinear and predetermined longitudinal length, a front one of said walls being provided with a plurality of equidistantly spaced tracks extending parallel to each other, said tracks traveling along a major portion of said front wall;

a plurality of coextensive electrical sockets partially positioned within said housing and including front faces exposed from said front wall for receiving a plurality of power cords from the auxiliary loads respectively;

means for independently positioning said electrical sockets along said tracks respectively such that said electrical sockets can be slidably guided between opposite ends of said housing as desired by a user; and an external power cord directly mated to said electrical sockets for supplying power thereto.

7. The power outlet of claim 6, wherein said independently positioning means comprises:

a plurality of motors including a plurality of drive gears provided with a serrated outer surface, said drive gears being directly connected to said motors and rotatably operable about a centrally registered fulcrum axis situated orthogonal to the longitudinal length of said housing, said motors and said drive gears being disposed within said housing;

a plurality of elongated and rectilinear driven shafts having opposed end portions directly conjoined to selected ones of said walls respectively, each said driven shafts having a threaded surface rotatable in clockwise and counter clockwise directions respectively;

a plurality of ring gears operably and directly connected to said drive shafts respectively, said ring gears being operably and directly positioned about said driven shafts in such a manner that said ring gears cause said driven shafts to rotate in a first direction when said drive shafts are rotated in a second direction; and a plurality of controls situated exterior of said housing and operably coupled to said motors respectively;

wherein said electrical sockets are directly and operably conjoined to said driven shafts in such a manner that said electrical sockets travel linearly along a longitudinal length of said tracks as said driven shafts are rotated in the clockwise and counter clockwise directions.

8. The power outlet of claim 7, wherein said independent positioning means further comprises:

at least one optical sensor directly fastened to one said end portions of said driven shaft and nested within said housing; and a transformer and a controller electrically mated to said external power cord;

wherein said optical sensor generates and transmits a control signal to said controller for notifying said controller whether said electrical sockets have been displaced a predetermined maximum distance along said driven shafts respectively, said controller generating and transmitting a response signal to said motors for automatically restricting the linear movements of said electrical outlets.

9. The power outlet of claim 7, wherein said electrical sockets are independently adaptable along said driven shafts.

10. The power outlet of claim 7, wherein said simultaneous positioning means further comprises:

a plurality of bearings directly nested about said opposed end portions of said driven shafts for promoting continuous and smooth rotation during operating conditions.

11. An adjustable power outlet for distributing electricity to auxiliary loads, said power outlet comprising:

a housing having a plurality of monolithically formed walls sized and shaped for defining a rectilinear and predetermined longitudinal length, a front one of said walls being provided with a plurality of equidistantly spaced and coextensive tracks extending parallel to each other, said tracks traveling along a major portion of said front wall;

a plurality of coextensive electrical sockets partially positioned within said housing and including front faces exposed from said front wall for receiving a plurality of power cords from the auxiliary loads respectively;

means for independently positioning said electrical sockets along said tracks respectively such that said electrical sockets can be slidably guided between opposite ends of said housing as desired by a user; and an external power cord directly mated to said electrical sockets for supplying power thereto.

12. The power outlet of claim 11, wherein said independently positioning means comprises:

a plurality of motors including a plurality of drive gears provided with a serrated outer surface, said drive gears being directly connected to said motors and rotatably operable about a centrally registered fulcrum axis situated orthogonal to the longitudinal length of said housing, said motors and said drive gears being disposed within said housing;

a plurality of elongated and rectilinear driven shafts having opposed end portions directly conjoined to selected ones of said walls respectively, each said driven shafts having a threaded surface rotatable in clockwise and counter clockwise directions respectively;

a plurality of ring gears operably and directly connected to said drive shafts respectively, said ring gears being operably and directly positioned about said driven shafts in such a manner that said ring gears cause said driven shafts to rotate in a first direction when said drive shafts are rotated in a second direction; and a plurality of controls situated exterior of said housing and operably coupled to said motors respectively;

wherein said electrical sockets are directly and operably conjoined to said driven shafts in such a manner that said electrical sockets travel linearly along a longitudinal length of said tracks as said driven shafts are rotated in the clockwise and counter clockwise directions.

13. The power outlet of claim 12, wherein said independent positioning means further comprises:

at least one optical sensor directly fastened to one said end portions of said driven shaft and nested within said housing; and a transformer and a controller electrically mated to said external power cord;

wherein said optical sensor generates and transmits a control signal to said controller for notifying said controller whether said electrical sockets have been displaced a predetermined maximum distance along said driven shafts respectively, said controller generating and transmitting a response signal to said motors for automatically restricting the linear movements of said electrical outlets.

14. The power outlet of claim 12, wherein said electrical sockets are independently adaptable along said driven shafts.

15. The power outlet of claim 12, wherein said simultaneous positioning means further comprises:

a plurality of bearings directly nested about said opposed end portions of said driven shafts for promoting continuous and smooth rotation during operating conditions.

* * * * *